US005409360A

United States Patent [19]

Wycliffe

[11] Patent Number: 5,409,360

[45] Date of Patent: Apr. 25, 1995

[54] VACUUM PUMPS

[75] Inventor: Henryk Wycliffe, Crawley, England

[73] Assignee: The BOC Group, plc, Surrey, England

[21] Appl. No.: 150,656

[22] Filed: Nov. 10, 1993

[30] Foreign Application Priority Data

Nov. 13, 1992 [GB] United Kingdom ..... 92 23 805.4

[51] Int. Cl.[6] ..... F01L 1/00

[52] U.S. Cl. ..... 418/258; 418/234

[58] Field of Search ..... 418/234, 257, 258, 265

[56] References Cited

U.S. PATENT DOCUMENTS

| | | | |
|---|---|---|---|
| 732,671 | 6/1903 | Andrews | 418/265 |
| 2,077,394 | 4/1937 | Buenger | 418/258 |
| 3,767,335 | 10/1973 | Kramer et al. . | |

FOREIGN PATENT DOCUMENTS

| | | |
|---|---|---|
| 1018888 | 4/1950 | France . |
| 146462 | 1/1974 | Germany . |
| 2404317 | 1/1974 | Germany . |
| 2915235 | 4/1979 | Germany . |

OTHER PUBLICATIONS

Method of Manufacturing Rotor of Pheumatic Motor Japan Abstract Appl. No. 54-117243 Date: Sep. 1979.

*Primary Examiner*—Richard A. Bertsch
*Assistant Examiner*—Charles G. Freay
*Attorney, Agent, or Firm*—David M. Rosenblum; Larry R. Cassett

[57] ABSTRACT

A rotary pump comprising a stator body having a bore and a rotor assembly mounted eccentrically in the bore to form a cavity between the stator body and the rotor assembly. The rotor assembly has two blades slidably positioned in diametrically opposed slots in the rotor assembly. In use of the pump the two blades are substantially in contact with an inner wall of the stator body. The stator body has an inlet and an outlet to allow, in use of the pump, fluid being pumped to enter into and be expelled from the cavity by means of the rotating vanes. The rotor assembly is of integral construction with each slot defined therein having an arcuate base and each blade has an end portion substantially conforming to the arcuate slot base.

7 Claims, 3 Drawing Sheets

VACUUM PUMPS

BACKGROUND OF THE INVENTION

This invention relates to mechanical rotary vacuum pumps and, more particularly to improvements in the rotors of such pumps.

Rotary vacuum pumps of the type having a rotor mounted for rotation in a stator body and being offset in relation to the stator bore such that two blades contained in, and slidable within, diametrically opposed slots in the rotor can cause gas entering the space between the stator and the rotor to be compressed and expelled into a pump outlet.

A typical arrangement in known pumps is shown schematically in FIG. 1 in the form of four vertical sections through the pump at four different phases thereof (induction, isolation, compressed and exhaust). There is shown a stator body 1 having a substantially cylindrical bore within which is eccentrically mounted a rotor 2 for rotation therein about its center line.

The rotor has two diametrically opposed slots within which are situated two blades 3,4 which can slide radially within the slots and are urged outwardly by means of a spring 5 such that the tips 6,7 of the blades 3,4 respectively are in contact with the stator wall at all times.

The stator body 1 has an inlet 8 to the bore and an outlet 9 therefrom, the outlet 9 also having a one-way exhaust valve 10.

The mechanism is generally lubricated by oil 11 contained in the pump body 12 in the form of a reservoir, small amounts of which are pumped into the pump interior to form a thin oil film between the working components before being ejected back into the reservoir through the exhaust valve 10 together with the pumped gas.

The rotor component itself is of complex design and construction in order to accommodate the two sprang blades. It commonly comprises an assembly as shown in FIG. 2—a sectional view through the assembly—and in FIG. 3—a separate sectional view along the line III—III of FIG. 2—having two half-cylindrical portions 20,21 defining therebetween one substantially continuous slot 22 for receiving two blades 23,24 of substantially rectangular shape and of a thickness very slightly less than that of the slot itself.

To hold the portions 20,21 together and to enable the rotor to be mounted for rotation in the pump body, boss elements 25,26 commonly formed integrally with shaft portions 27 and 28,29 respectively and all of cylindrical cross section are joined to the portions 20,21. Bearing and shaft seal surfaces are provided by the shaft portions 27 and 29.

The complete rotor assembly is then mounted within pump body bearings for rotation therein by means of a motor in the usual way. It will be appreciated, however, that the construction of such a known rotor assembly is complicated and therefore expensive.

SUMMARY OF THE INVENTION

The present invention is concerned with the provision of a rotor for a rotary vacuum pump which is generally less complicated in design and in manufacture.

In accordance with the invention, there is provided a rotary pump comprising a stator body having a bore and a rotor assembly mounted eccentrically in the bore to form a cavity between the stator body and the rotor assembly, the rotor assembly having two blades slidably positioned in diametrically opposed slots in the assembly which in use of the pump are substantially in contact with an inner wall of the stator body, and the stator body having an inlet and an outlet to allow, in use of the pump, fluid being pumped to enter into and be expelled from the cavity by means of the rotating vanes, wherein the rotor assembly is of integral construction with each slot formed therein having an arcuate base and wherein each blade has an end portion substantially conforming to the arcuate slot base.

In general, the rotor assembly in pumps of the invention will comprise two substantially half-cylindrical (cheek) portions together with end portions, for example bosses, to connect the half-cylindrical portions in the correct position relative to each other and, preferably, shaft portions attached to each end portion including thereon bearing and seal surfaces.

The integral construction of the rotor itself, and of as many other rotor components as is expedient, for example boss portions, to form a complete rotor assembly means that the rotor can be manufactured from a solid bar (or similar) material, preferably in a single series of milling or cutting operations which can advantageously be effected on a single machine.

The basis of the invention is that, additionally, each slot may be formed in the rotor by a single (circular) cutter operation (to form the arcuate base to the slot), ideally in the same series of operations and for the blades each to have an end portion substantially conforming to the arcuate base of the slot.

The end portions of the blades can conform to the arcuate shape of the slots exactly by having an arcuate end having substantially the same radius as that of the slots, or having a somewhat different profile such that they fit within their respective slots. Alteratively, the end portions of the blades can be tapered, for example be 'V'-shaped or have multi-sided polygonal ends.

Generally, the opposite ends of the blades will be of normal right angled shape in order for the opposite ends to contact the stator body internal wall along their entire length.

Preferably, the cub forming the arcuate base of each slot will be somewhat deeper than the main axis of the rotor so that the slots are linked along some, but clearly not all, of the main axis line. Alteratively, overlap and the bases of each slot may be linked by separate means if the cub themselves do not overlap in the rotor body.

Spring means for urging the respective blades radially outwardly may be employed. If the slots in the rotor are linked, the spring means may be positioned in the linking area.

A benefit of the invention, however, is that the use of a blade with a "tapered" end in accordance with the invention (in contrast to a vane of overall rectangular shape) places the center of gravity of the blade further from the rotor centre line or axis of rotation. This generally allows the blades to be subjected to increased centrifugal forces and to slide more smoothly in their slots; this allows for a greater possibility of operation of the blades in contact with the stator internal wall without the use of spring means between the blades.

Whereas the stator body and rotor will generally be made from iron or steel, the composition of the blades may be metal, preferably coated with a "non-stick"

layer or alternatively be made of plastic or a fibrous based material.

BRIEF DESCRIPTION OF THE DRAWINGS

For a better understanding of the invention, and to exemplify specific embodiments of the invention, reference will now be made to the accompanying drawings in which.

DETAILED DESCRIPTION

Figure 1:
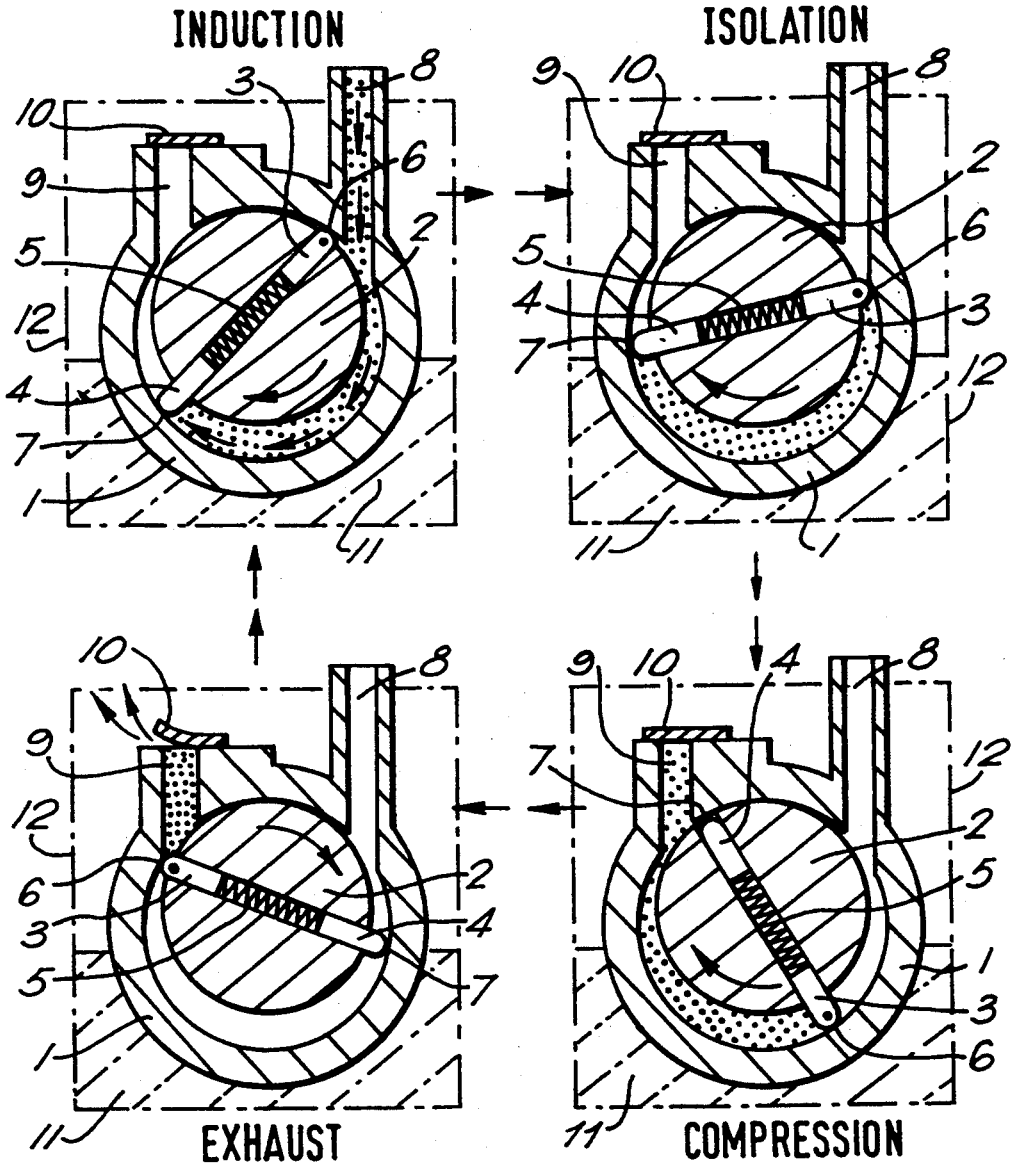
FIG.1. PRIOR ART
FIG. 1 is schematic of the four phases of a prior art rotary vacuum pump.
Figure 2:
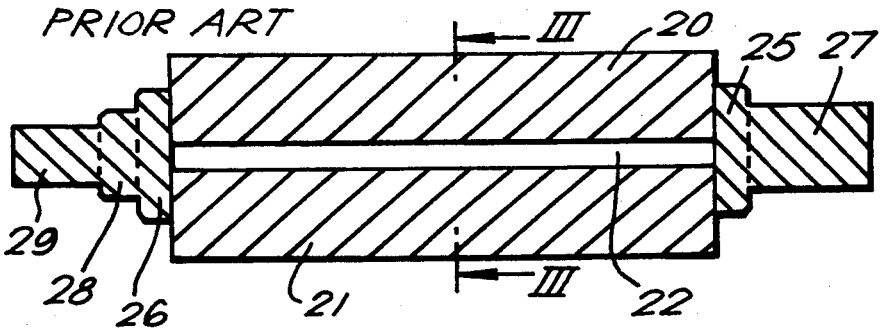
FIG. 2. PRIOR ART
FIGS. 2 and 3 show a prior art rotor for a rotary vacuum pump.
Figure 3:
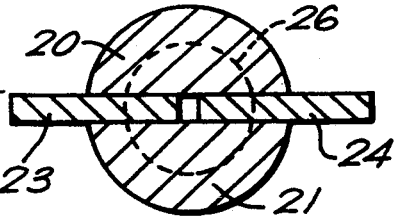
FIG.3. PRIOR ART
Figure 4:
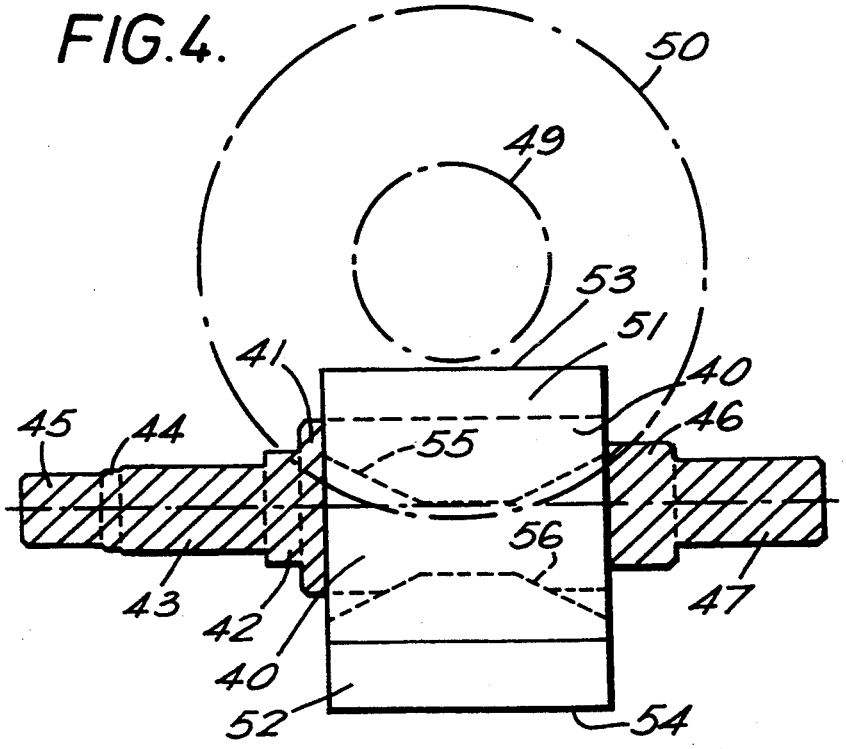
FIG. 4 shows schematically a view (partly in section) along the centre line of a rotor assembly for a vacuum pump of the invention.

With reference to FIG. 4, there is shown a rotor assembly comprising a rotor 40 integrally formed, at one end, with boss portions 41,42 and with shaft portions 43,44,45. Integrally formed with the rotor 40 at the other end is a boss portions 46 and 47 arranged to be coupled to a drive from a motor.

The rotor itself is formed with two diametrically opposed slots positioned vertically in the Figure and cut out of the solid rotor by means of a circular cutter 50, and rotating about a shaft 49, shown schematically in position for the upper slot in FIG. 4, thereby providing arcuate bases for the slots. The lower slot is similarly cut; both slots are approximately 6 mm wide.

Each slot receives a blade 51,52 having a width slightly less than the 6 mm width of the slots themselves. Each blade has a right-angled outer end 53,54 respectively with the inner ends 55,56 received by the slots being of multi-sided (tapered) such that each substantially conforms to the arcuate base of each slot.

The blades can operate in the pump and allow for their ends 53,54 to be in contact with the stator wall throughout the various pump stages of operation by means of centrifugal forces causing the contact. The need for spring means urging the blades radially out of the slots are thus obviated, primarily by virtue of the lower weight and different centers of gravity in comparison with conventional blades.

As shown in FIG. 4, the blades protrude from the surface of the rotor 40 to different degrees to account for the tips 53,54 being in contact with the inner surface of the stator within which the rotor is mounted. Clearly the position of the blades within the slots will vary as the rotor rotates.

The depth of the slots for receiving the blades may vary from rotor to rotor. It is generally desirable for the inner edge of each blade just to be able to contact the other when both blades are completely withdrawn into their respective slots. In FIG. 4, the blade 51 is shown in that position with its innermost edge being on the centre-line of the rotor assembly.

Figure 5:
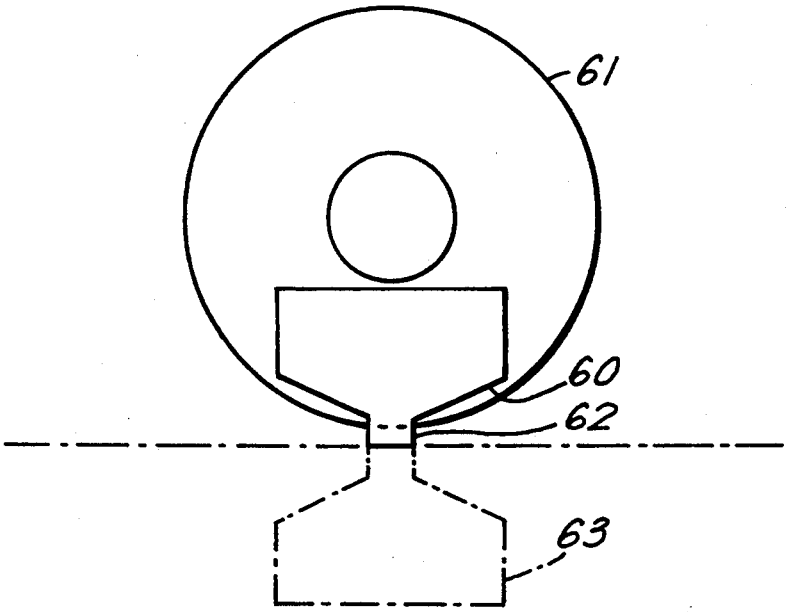
FIG. 5 shows a blade for use in vacuum pumps of the invention having a different shape to those of FIG. 4.

In certain cases, it may be desirable for the depth of slot as made by the cutter 50 to be smaller although it is generally necessary for the slots to be linked. FIG. 5 shows an alterative blade shape to that of FIG. 4 which enables this to be achieved. Generally, the blade shown in FIG. 5 has an end portion 60 substantially conforming to the less deep arcuate slot base formed by the cutter 61 but with an extended portion 62 of a width allowing the respective blades to contact each other via a separately formed link between the respective slots made by the cutter 61. The other blade 63 is shown in dotted lines in its innermost position in the rotor assembly.

In manufacturing an integral rotor assembly of the invention, difficulties might be encountered in ensuring that the slots made in the opposite sides of the assembly are fully aligned, i.e. are free of any ridges in the area of overlap between the ends of the slots. The presence of such ridges might affect the operation of the pump by preventing full blade movement or by causing uneven forces to be applied across the blades.

In accordance with preferred embodiments of the invention, however, the respective slots are deliberately formed in the rotor assembly in a controlled manner such that the slot walls against which the respective blades bear along the full stroke of their movement within the slots are devoid of ridges or other imperfections.

This can be achieved in practice by deliberately positioning the respective slots (for example by setting the cutter in relation to the rotor body) such that the respective slots are offset by, say, about 0.5 mm as measured at the base of the slots and in a direction which forms a continuous surface for the relevant side of each blade.

Figure 6:
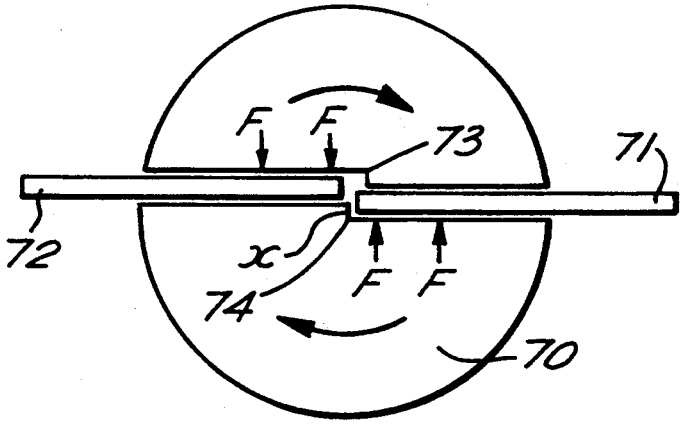
FIG. 6 shows a schematic section through a rotor assembly of the invention showing "offset" blade slots.

FIG. 6 shows schematically the implementation of these embodiments in the form of a sectional view through a rotor assembly of the invention. It shows a rotor 70 with two blades 71,72 contained in respective slots in the manner described above. The slots are cut in the rotor body such that they are offset by a 0.5 mm step measured at 'x'.

The rotor is arranged for rotation in the direction shown by the arrows causing forces 'F' to be applied to the blades. The manner of the offset for the slots is such that these forces 'F' are applied to the blades on the side of the blades communicating with the slot wall having no step along the whole length of the respective blade movement; blade 71 in particular is shown fully retracted into its slot. Overall, this ensures a continuous flat surface for the "loaded" sides of each blade.

In the event that the offset was reversed, it is clear that the forces 'F' would be applied partly when the relevant blade sides were adjacent the type of step shown at 73,74.

I claim:

1. A rotary pump comprising: a stator body having a bore; a rotor assembly of integral construction comprising two substantially half cylindrical portions and end portions connecting the two half cylindrical portions in position, said rotor assembly mounted eccentrically in the bore to form a cavity between the stator body and the rotor assembly; an inlet and an outlet defined within the stator body to allow fluid being pumped to enter into and be expelled from the cavity; the rotor assembly having two blades substantially in contact with an inner wall of the body and slidably positioned in two diametrically opposed slots having an arcuate base; and each of the two blades having an end portion substantially conforming to the arcuate slot base.

2. The rotary pump according to claim 1 in which the blades each have an end portion substantially conforming to the arcuate base of the slots.

3. The rotary pump according to claim 1 in which the rotor has a main axis and the arcuate base of each the two slots is deeper than the rotor along a portion of said main axis.

4. The rotary pump according to claim 1 further comprising spring means for urging the respective blades outwardly within the rotor assembly.

5. The rotary pump according to claim 1 in which the two slots have slot walls against which the respective blades bear along the full stroke of their movement

6. The rotary pump according to claim 5 in which the two slots are offset from each other.

7. The rotary pump according to claim 6 in which the slots have a base and are offset by about 0.5 mm as measured at the base of the slots.

* * * * *